United States Patent [19]

Stapel et al.

[11] Patent Number: 4,981,094

[45] Date of Patent: Jan. 1, 1991

[54] SEWING MACHINE HAVING A DEVICE ACTUABLE BY A PRESSURE MEDIUM FOR APPLYING A VARIABLE FORCE TO A PRESSER ELEMENT

[75] Inventors: Wilhelm Stapel, Bielefeld; Hans-Rolf Goebbels, Hiddenhausen, both of Fed. Rep. of Germany

[73] Assignee: Durkoppwerke GmbH, Fed. Rep. of Germany

[21] Appl. No.: 361,376

[22] Filed: Jun. 5, 1989

[30] Foreign Application Priority Data

Jun. 9, 1988 [DE] Fed. Rep. of Germany ..... 8807493

[51] Int. Cl.[5] ..... D05B 29/02

[52] U.S. Cl. ..... 112/235

[58] Field of Search ..... 112/60, 61, 80.73, 150, 112/151, 235, 236, 237, 239, 240, 314, 320

[56] References Cited

U.S. PATENT DOCUMENTS

| | | | |
|---|---|---|---|
| 2,541,888 | 2/1951 | Pinkvoss | 112/235 |
| 2,750,090 | 6/1956 | Odermann et al. | 112/235 |
| 3,601,072 | 8/1971 | Husted | 112/239 X |
| 4,214,540 | 7/1980 | Cook | 112/235 |
| 4,381,722 | 5/1983 | Takeuchi et al. | 112/f235 |

FOREIGN PATENT DOCUMENTS

| | | | |
|---|---|---|---|
| 3530731 | 3/1986 | Fed. Rep. of Germany | 112/235 |
| 2120883 | 6/1987 | Japan | 112/235 |

*Primary Examiner*—Werner H. Schroeder
*Assistant Examiner*—David K. Suto
*Attorney, Agent, or Firm*—Osterlenk, Faber, Gerb & Soffen

[57] ABSTRACT

A device in a sewing machine for applying a variable downward force to a presser bar. A guide lever engages the presser bar and in turn is urged downward by the force of a spring. The bottom of the spring is held fixed to a lock sleeve on the guide lever. The top of the spring is fixed to a sleeve on a shaft which is disposed vertically inside the spring. The shaft passes freely out the bottom of the spring and through the guide lever without engaging either of these. The shaft and thereby the top of the spring are urged downward by a controllable pneumatic device in order to set the compression of the spring and thereby the downward force applied to the pressure bar by the guide lever. The pneumatic device preferably includes a pair of separately controlled pneumatic pistions arranged in series for moving the shaft to at least two predetermined positions.

21 Claims, 3 Drawing Sheets

SEWING MACHINE HAVING A DEVICE ACTUABLE BY A PRESSURE MEDIUM FOR APPLYING A VARIABLE FORCE TO A PRESSER ELEMENT

BACKGROUND OF THE INVENTION

The invention relates to a pressure-fluid actuated device for applying a variable pressing force to a presser element, said device including a spring disposed in the arm head of the sewing machine.

A presser drive of this general type is disclosed in German Unexamined Application for Patent OS No. 36 04 299, in which the piston rod of a double-acting compressed-air cylinder is directly connected to the presser bar. The disclosures of this, as well as all other prior art documents cited herein, are incorporated by reference.

This device, by acting on the two cylinder spaces present in the cylinder, which action is controlled by a control unit, can change the pressing force with which the material to be sewn is pressed against a needle plate by a presser foot attached to the presser bar. However, since the piston present in the cylinder is directly connected to the presser bar, the up-and-down movement of the cloth-feed device during sewing is transmitted to the piston via the presser foot and the presser bar. The resulting highspeed movement of the piston leads to early wear of the sealing element of the piston and therefore this known presser drive is practically usable only for a few stitches at the beginning of the seam. It accordingly cannot be used for a lengthy seam.

The principal object of the invention is to provide an improved device of the foregoing type, which will permit substantially wear-free operation, even when long seams are sewed.

This object is achieved by a sewing machine having the features disclosed and claimed herein. According to a preferred embodiment, in a sewing machine having an arm head, and below the arm head at least one presser bar which raises and lowers a presser foot for applying a force to a sewing-material workpiece, the improvement of the invention comprises a device for applying a variable downward force to said presser bar, said device comprising: spring means linked to said presser bar for exerting said downward force; and servo means linked to said spring means for controllably varying a resilient force thereof and thereby varying said downward force exerted by said spring means. It further comprises compressing means actuated by said servo means for engaging said spring means and controllably varying its resilient force. The spring means may comprise a spring and said compressing means may comprise a shaft linking said servo means to said spring. Advantageously, the shaft passes through the spring, is positioned by the servo means, and engages the spring to set its length.

According to another advantageous feature, said spring is settable to a plurality of predetermined lengths, as determined by control means connected to said servo means. The control means includes piston means and comprises a valve for controlling application of a pressure medium to the piston means. The pressure medium is controllable to set said spring to a plurality of predetermined lengths.

According to a preferred embodiment, the piston means comprises at least first and second pistons and the control means controls the pistons independently of each other.

In a particularly advantageous feature, a guide lever receives the force of the spring and engages the presser bar for applying said downward force thereto.

With this device it is now possible in a very simple manner to apply different pressing forces to the presser foot during the sewing of a particular seam. In this way, in particular, a partial working in of additional width—for example when the upper or lower layer of material to be sewn is gathered—is made possible without the intermediate plate which has heretofore been indispensable for such sewing work. Up to now such an intermediate plate—as known for example from German Utility Model 84 33 111—had to be swung into the region where the stitch is formed, when performing gathering work, in order to spatially separate the two layers of material to be sewn.

These and other objects, features and advantages of the invention will be understood from the following detailed description of an embodiment thereof, with reference to the drawings.

DETAILED DESCRIPTION

Figure 1:
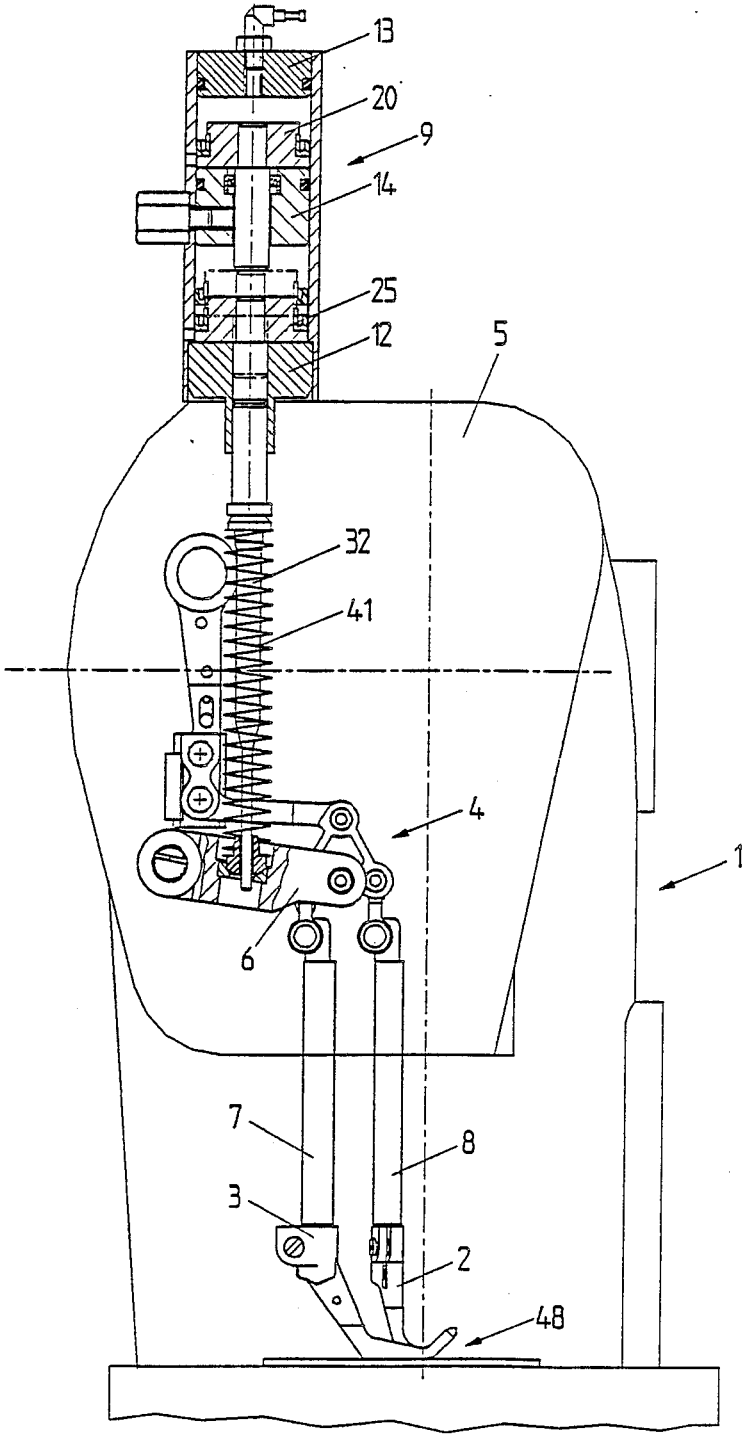
FIG. 1 is a side view of a sewing machine according to a disclosed embodiment of the invention, shown in simplified cross-sectional view.

FIG. 1 shows a sewing machine 1 having a skipping bottom feed (not shown), and a top feed device comprising an advancing foot 2, a holding foot 3, and a flat crank gear 4 which alternates the operation of the feet 2, 3.

The bottom feed and other general aspects of the sewing machine 1 are already disclosed in German Patent No. 30 43 141, so a detailed description thereof can be dispensed with here. Also, although the disclosed embodiment relates to the cooperation of the device of the invention with the above-described known sewing machine, having a top feed device, it should be understood that the device of the invention can also be installed on a single or multi-needle sewing machine that does not have a top feed device.

In an arm head 5 of the sewing machine 1, a guide member 6, which affects the stroke of the presser bars 7, 8, is pivotally mounted.

Figure 2:
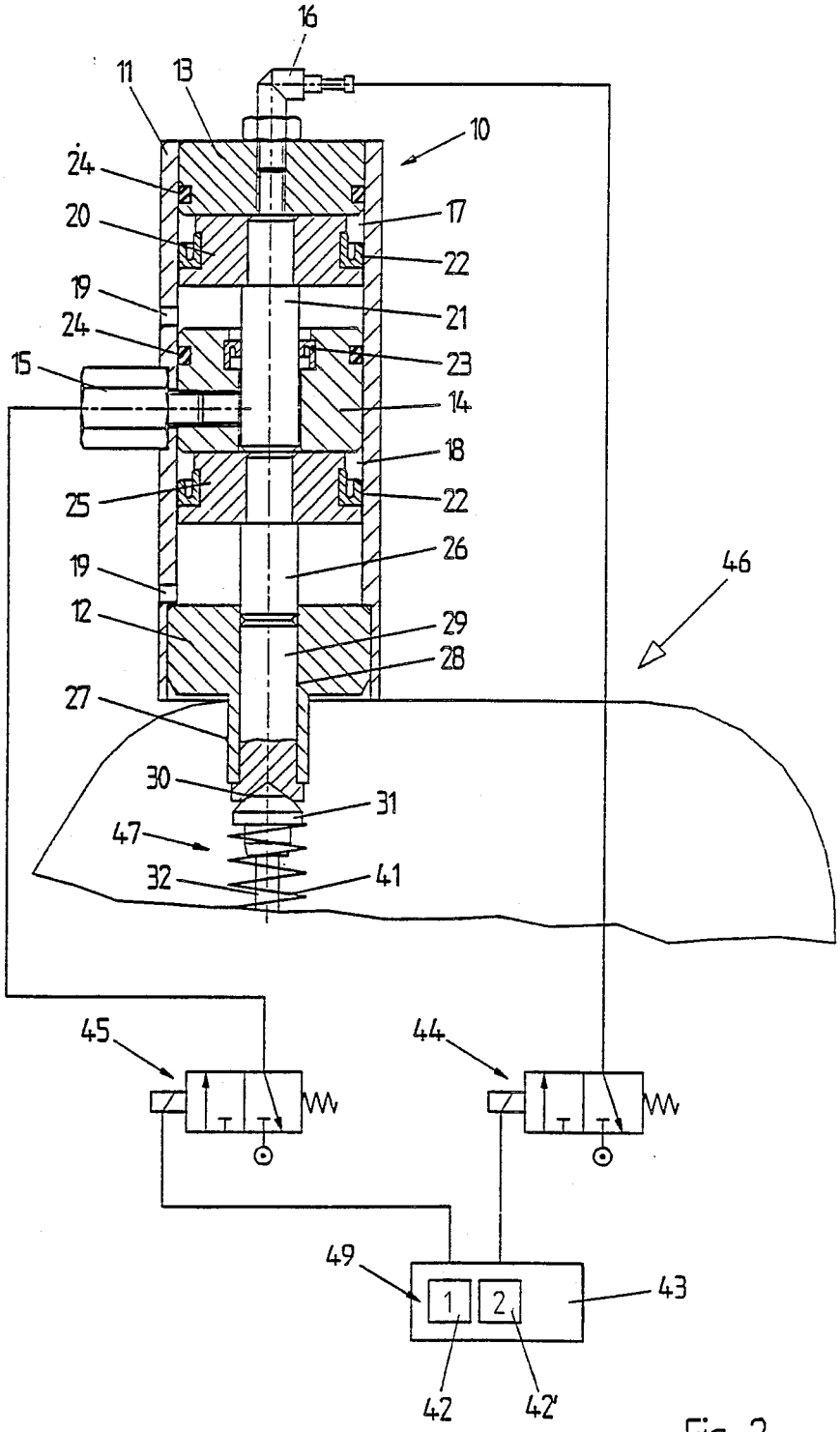
FIG. 2 is a cross-sectional view of the embodiment and its electro-pneumatic control means.

A servo-element 9 is rigidly connected to the arm head 5. In this embodiment the servo-element is an electropneumatically actuatable, two-stage single-acting cylinder 10. Other suitable types of servo-element are also usable. The cylinder consists of a cylinder tube 11, the lower opening of which is closed off by a bearing cover 12, and the upper opening being closed by a closure cover 13. Between the two covers there is provided an intermediate ring 14 which is rigidly connected to the cylinder tube 11 by a commercially available hose connection 15, as shown in FIG. 2.

The closure cover 13, which is rigidly connected to the cylinder tube 11, for example by a threaded connection, has a further commercially available hose connection 16. Due to the construction of the cylinder 10 which has just been described, the cylinder 10 has two cylinder spaces 17, 18, each of which is provided with a vent bore 19.

In the cylinder space 17 is disposed a piston 20 and a bolt 21 which are rigidly connected to each other. A commercially available lip sealing ring 22 is provided on the piston 20. The protruding part of the bolt 21 is received by the intermediate ring 14 via a further lip sealing ring 23 provided in it. One sealing ring 24 each—for example a commercially available O-ring—is provided in the intermediate ring 14 and in the closing cover 13 in order to seal them off from the cylinder tube 11.

In the cylinder space 18 there is provided a further piston 25 with a bolt 26 which are rigidly connected to each other. The piston 25 is also equipped with a lip sealing ring 22.

An extension 27 provided on the bearing cover 12 is provided with an outside thread so that the cylinder 10 can be screwed into the arm head 5. The bore 28 in the bearing cover 12 receives the bolt 26 as well as a ram 29. On the protruding end of the latter there is provided a pointed counterbore 30 with which the spherical surface of a first articulated sleeve 31 comes into contact in installed condition. The first articulated sleeve 31 is firmly connected to a rod 32 by a screw connection, the rod 32 preventing the bending-out of a compression spring 41 described below and maintaining this spring in position.

Figure 3:
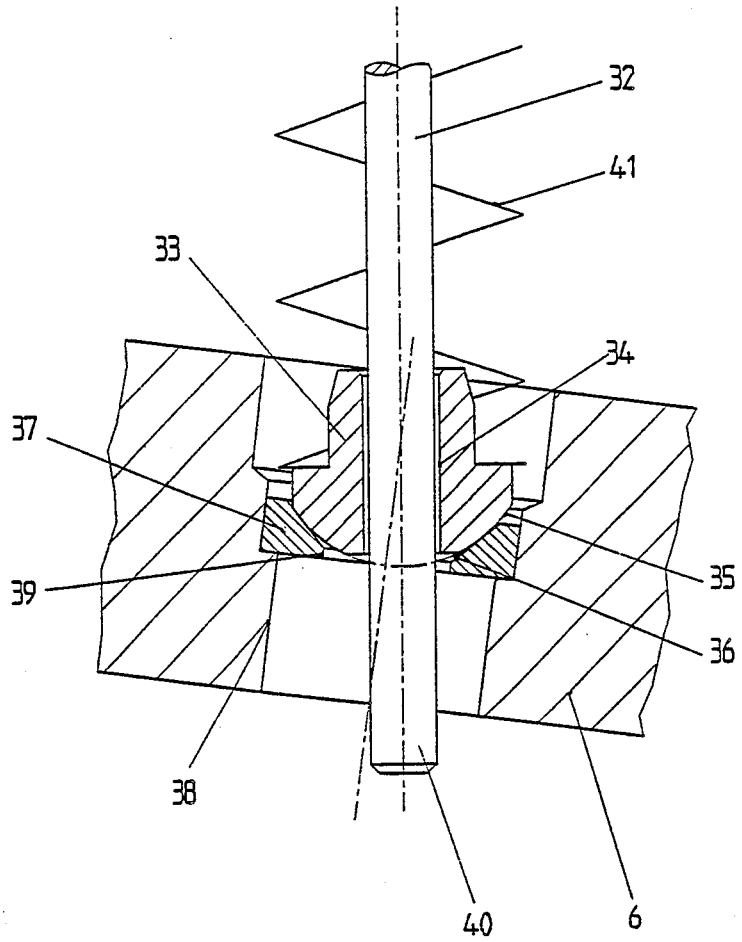
FIG. 3 is a cross-sectional view of the lower articulated sleeve provided on the guide member.

Referring to FIG. 3, at the other end of the rod 32 there is provided a second articulated sleeve 33 which has a bore 34 the diameter of which is larger than the outside diameter of the rod 32. The spherical end 35 of the articulated sleeve 33 rests against a correspondingly shaped mating surface which is part of a ring 37. In this embodiment the mating surface is an angularly tapered depression 36 in the ring 37. It could also be a spherical indentation or have another suitable shape. As shown in FIG. 3, the ring 37 is pressed into the countersink of a hole 38 provided in the above-mentioned guide member 6 (FIG. 1). The ring 37 has a hole 39 the diameter of which is larger than the outside diameter of the rod 32. In this way, the free end 40 of the latter can, within certain limits, move freely in the guide member 6.

The two projections of the articulated sleeves 31, 33 receive the ends of the compression spring 41, which in the vernacular of the trade is also referred to as the so-called presser spring.

On the arm head 5 there are provided two conventional contacts or pneumatic switches 42, 42' which can be reached quickly and freely by the sewing machine operator for enabling a simple operation. The contacts 42, 42' belong to a control unit 43 which controls the functionally proper application of compressed air on the cylinder 10 and the duration thereof Two 3/2 solenoid valves 44, 45 are provided for this purpose.

The manner of operation of this embodiment of the invention will now be described:

When both contacts 42, 42' have been placed in their active position by pressing them in, the cylinder space 17 will be acted on by compressed air from an external source of compressed air (not shown) via the solenoid valve 44, and likewise the cylinder space 18, via the solenoid valve 45. As a result thereof, the piston 20 moves until it abuts against the top side of the intermediate ring 14 and the piston 25 moves simultaneously until it abuts against the top side of the bearing cover 12. The air which is present between piston 20 and intermediate ring 14 and between piston 25 and bearing cover 12 is able to escape through the corresponding vent bores 19. As shown in FIG. 2, the ram 29 is thereby displaced into its lowest position via the bolt 26, as a result of which the compression spring 41 is now compressed to its minimum spring length. In this condition, as shown in FIG. 1, the presser—which in this embodiment is alternately the holding foot 3 or the feed foot 2—is pressed with maximum force against the material to be sewn. This setting is intended for smooth, crimp-free sewing.

If the contact 42 is placed in its inactive position, then the cylinder space 18 is no longer acted on by compressed air. The bolt 21 is now in its lower position The piston 25 is pressed against the bottom side of the bolt 21 by the compression spring 41, which now relaxes to some extent, and this piston 25 assumes the position shown by dash-dot lines in FIG. 1. Thus, spring 41 now has a longer spring length. In this case the presser is pressed against the material to be sewn with less force. This setting is chosen when using heavy to medium-weight sewing material, and when one layer of material is to be crimped onto the other.

Finally, when both contacts 42, 42' have been placed in their inactive position, the pistons 20, 25 assume the position shown in FIG. 2, whereby the compression spring 41 is imparted its maximum spring length. As a result thereof, the presser is pressed against the material to be sewn with minimal force. This setting is chosen if, in the case of lightweight material to be sewn, one layer of material is to be crimped onto the other.

It should also be understood that in other embodiments than the embodiment described here, the cylinder 10 could be provided with more than two stages, whereby it would be possible to assign more than three defined spring lengths to the compression spring 41. Another suitable type of servo-element, for example one that is not actuated by a pressure medium, could also be used.

Although one embodiment of the invention has been described herein, the appended claims are not to be construed as limited to such embodiment, but should be understood to cover all modifications and variations that are fairly within the inventive teachings set forth herein.

What is claimed is:

1. In a sewing machine having an arm head, and below the arm head at least one presser bar which raises and lowers a presser foot for applying a force to a sewing-material workpiece, the improvement comprising a device for applying a variable downward force to said presser bar, said device comprising:

a spring linked to said presser bar for exerting said downward force; and a multistage pressure cylinder linked to said spring for controllably setting compression of said spring and thereby varying said downward force exerted by said spring.

2. A device as in claim 1, further comprising compressing means actuated by said cylinder for engaging said spring and controllably varying its compression and thereby its resilient force.

3. A device as in claim 2, wherein said compressing means comprises a shaft linking said cylinder to said spring.

4. A device as in claim 3, wherein said shaft passes through said spring.

5. A device as in claim 4, wherein said spring is compressed between a pair of sleeves, which are locked respectively to said shaft and to a guide lever which engages said presser bar and applies said downward force thereto.

6. A device as in claim 3, wherein said shaft is positioned by said cylinder and engages said spring so as to set its length.

7. A device as in claim 1, wherein said multistage pressure cylinder is controllable by an exterior source of pressure fluid.

8. A device as in claim 7, wherein said multistage cylinder includes piston means, and has receiving means for receiving a pressure medium for setting a position of said piston means to set a position of said shaft.

9. A device as in claim 8, wherein said piston means is controllable by pneumatic pressure.

10. A device as in claim 8, wherein said spring is settable to a plurality of predetermined lengths.

11. A device as in claim 10, further comprising control means connected to said cylinder for controlling the same.

12. A device as in claim 11, wherein said control means includes a valve for controlling application of said pressure medium to said piston means.

13. A device as in claim 12, wherein said pressure medium is controllable to set said spring to a plurality of predetermined lengths.

14. A device as in claim 11, wherein said control means is attached to said sewing machine near the sewing location thereof.

15. A device as in claim 1, wherein said spring and cylinder are attached to said arm head.

16. A device as in claim 1, further comprising a guide lever receiving the force of said spring and engaging said presser bar and applying said downward force thereto.

17. In a sewing machine having an arm head, and below the arm head at least one presser bar which raises and lowers a presser foot for applying a force to a sewing-material workpiece, the improvement comprising a device for applying a variable downward force to said presser bar, said device comprising:

a spring linked to said presser bar for exerting said downward force; and servo means linked to said spring for controllably varying a resilient force thereof and thereby varying said downward force exerted by said spring;

compressing means comprising a shaft actuated by said servo means for engaging said spring to set its length and controllably vary its resilient force;

wherein said servo means includes piston means, and has receiving means for receiving a pressure medium for setting a position of said piston means to set a position of said shaft;

further comprising control means which includes a valve for controlling application of said pressure medium to said piston means to set said spring to a plurality of predetermined lengths;

wherein said piston means comprises at least first and second pistons and said control means controls said pistons independently of each other.

18. A device as in claim 17, wherein said second piston engages said shaft and sets its position.

19. A device as in claim 18, further comprising an intermediate ring which limits the position of said first and second pistons, and a pin which passes through said intermediate ring, said pin being positioned by said first piston and engaging said second piston below said intermediate ring for further limiting the position of said second piston.

20. A device as in claim 19, wherein said intermediate ring is fixedly accommodated between said pistons within a substantially closed cylinder tube.

21. In a sewing machine having an arm head, and below the arm head at least one presser bar which raises and lowers a presser foot for applying a force to a sewing-material workpiece, the improvement comprising a device for applying a variable downward force to said presser bar, said device comprising:

a spring linked to said presser bar for exerting said downward force; and servo means linked to said spring for controllably varying a resilient force thereof and thereby varying said downward force exerted by said spring;

compressing means comprising a shaft actuated by said servo means for engaging said spring to set its length and controllably vary its resilient force;

wherein said servo means includes piston means, and has receiving means for receiving a pressure medium for setting a position of said piston means to set a position of said shaft;

further comprising control means which includes a valve for controlling application of said pressure medium to said piston means;

wherein said pressure medium is pneumatic, and further comprising at least one pneumatic switch which controls said pressure medium.

* * * * *